United States Patent [19]

Yu

[11] Patent Number: 4,748,776

[45] Date of Patent: Jun. 7, 1988

[54] ROOFING CONSTRUCTION WITH HOLLOW CERAMIC BLOCKS

[76] Inventor: Shu-Shyan Yu, 2F., No. 7, Long 4, Lane 291, Sec. 1, Shui-Yuan Rd., Hsi-Chih, Taipei, Taiwan

[21] Appl. No.: 58,845

[22] Filed: Jun. 5, 1987

[51] Int. Cl.[4] ..... E04B 7/00

[52] U.S. Cl. ..... 52/22; 52/506; 52/606; 62/DIG. 16; 62/304

[58] Field of Search ..... 52/506, 22, 169.7, 198, 52/606; 126/415; 62/DIG. 16, 304

[56] References Cited

U.S. PATENT DOCUMENTS

| | | | |
|---|---|---|---|
| 152,996 | 7/1874 | Hoyt | 52/22 |
| 567,173 | 9/1896 | Schillinger | 52/606 |
| 599,664 | 3/1898 | Rapp | 52/606 |
| 743,158 | 11/1903 | Herbert | 52/22 |
| 1,187,494 | 6/1916 | Bryan | 52/506 |
| 3,908,324 | 9/1975 | Stout | 52/405 |
| 4,020,605 | 5/1977 | Zenos | 52/506 |
| 4,228,729 | 10/1980 | Messick | 52/22 |
| 4,280,484 | 7/1981 | Mancosu | 52/506 |
| 4,414,786 | 11/1983 | Frahme | 52/506 |

FOREIGN PATENT DOCUMENTS

| | | | |
|---|---|---|---|
| 45021 | 9/1938 | Netherlands | 52/22 |

*Primary Examiner*—John E. Murtagh
*Assistant Examiner*—Caroline D. Dennison
*Attorney, Agent, or Firm*—Bucknam and Archer

[57] ABSTRACT

A protection layer upon a building roof is constructed with hollow ceramic blocks which after laying constitute a water pool with desirable depth and an air space thereupon to provide insulation against temperature and weather abuse when the roof is otherwise exposed directly under rain or shine. A typical block has generally rectangular hollow cross section to facilitate free channelling of water and air. Openings are provided on top of each block for the intake of water from overhead, and drain openings are optionally provided in the bottom of selected blocks to communicate with the downpour drainage of the roof. The height of the overflow pipe is adjustable to set a desirable level of water reserved in the pool.

4 Claims, 4 Drawing Sheets

ROOFING CONSTRUCTION WITH HOLLOW CERAMIC BLOCKS

The present invention relates generally to a protection layer upon a building roof and the hollow ceramic blocks for the construction thereof. The as-built layer constitutes a free-flowing water pool with a pre-set desirable depth. The reserved water with the air space thereupon provides an insulation against the temperature and weather abuse when the roof is othewise exposed directly under rain or shine.

The top floor residences of an apartment or mansion building would mostly complain of the unbearable radiant heat from atop when the roof is scorched directly under the summer sun, as well as the cold during winter draft and snow. While the roof is usually constructed with materials such as cement, leakages are experienced during the shower or snow-thawing days when the drainage becomes poor after long abuse of weather toward the roofing material.

Air conditioning shall have to be provided to fight the hot or cold sufferings, comfort is synonymous with energy consumption.

Therefore, the main object of the present invention is to provide a protection layer upon a building roof constructed with hollow ceramic blocks. The arrangement would result typically into a free flowing water pool with desirable depth and an air space thereupon to provide insulation against the temperature and weather abuse when the roof is otherwise exposed directly under rain or shine.

Another object of the present invention is to provide the building block for the said roof protection layer. The as-built layer proper, no matter what variant the pattern may take, would be made up of a typical first modular block having four surrounding walls to enclose a hollow part and a second modular block having the same hollow part but with a drain opening provided in the bottom wall to facilitate drainage. The hollow parts of the block are connected to form free channelling for water and air flow therein.

A further object of the present invention is to provide each of the aforesaid first and second modular blocks with a back wall so that the part can not be see-through and said modified blocks can be laid around against the dadoes of the roof boundaries.

A still further object of the present invention is to provide an overflow pipe which is to protrude from the drain opening of the second modular block and be inserted in a water-tight manner therein yet be easily adjustable to control the pool level and dismountable to effect cleaning.

A still further object of the present invention is to chamfer the two upper corners of the cross section to form tapered surfaces with downward slope, providing an elongated slot through each surface. An opening with a size corresponding to the drain opening is formed in the top wall and aligned with the drain opening to facilitate the handling within the hollow space. Said elongated slot and the handling opening both serve to intake water from overhead.

Other objects and features of the present invention will become apparent when detailed description is made accompanied by the annexed drawings, where:

Before referring to FIG. 1, the general layout of a typical roof protection layer according to the present invention, the nomenclature and numerization of the modular blocks are defined as follows:

10—First modular block with a hollow space surrounded by four walls;

10M—Ditto—but modified with the provision of an additional back wall;

20—Second modular block having same structural features as the first one, but provided with drain opening in the bottom wall and handling opening in the top wall;

20M—Ditto—but modified with the provision of an additional back wall; and,

X—suffix "X" means the width(W) of the block is doubled.

Figure 3A:
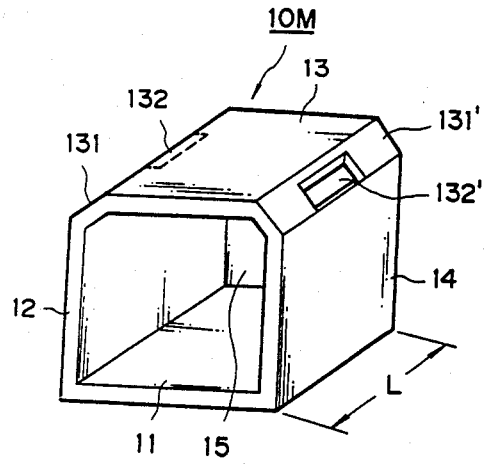
FIGS. 3A and 3B are a perspective and a cross sectional view respectively of a first modular block modified with the provision of a back wall.
Figure 3B:
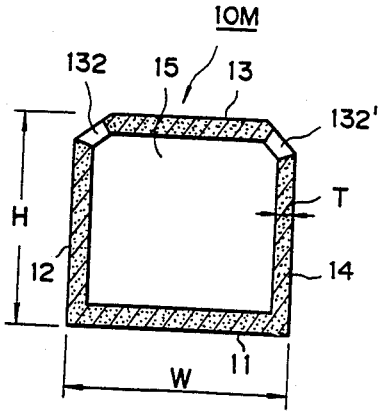
Figure 4A:
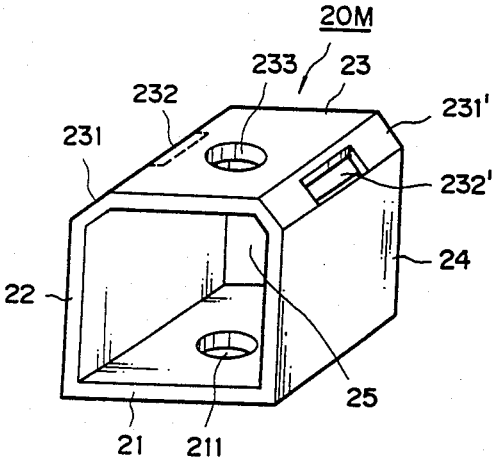
FIGS. 4A and 4B are a perspective and a cross sectional view respectively of a second modular block modified with the provision of a back wall.
Figure 4B:
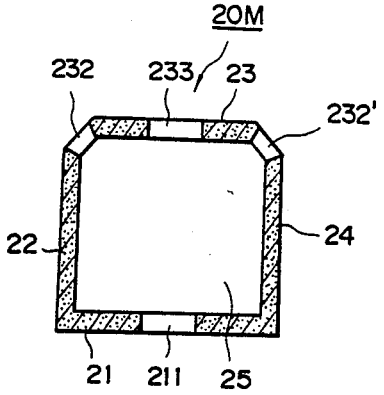
Figure 5A:
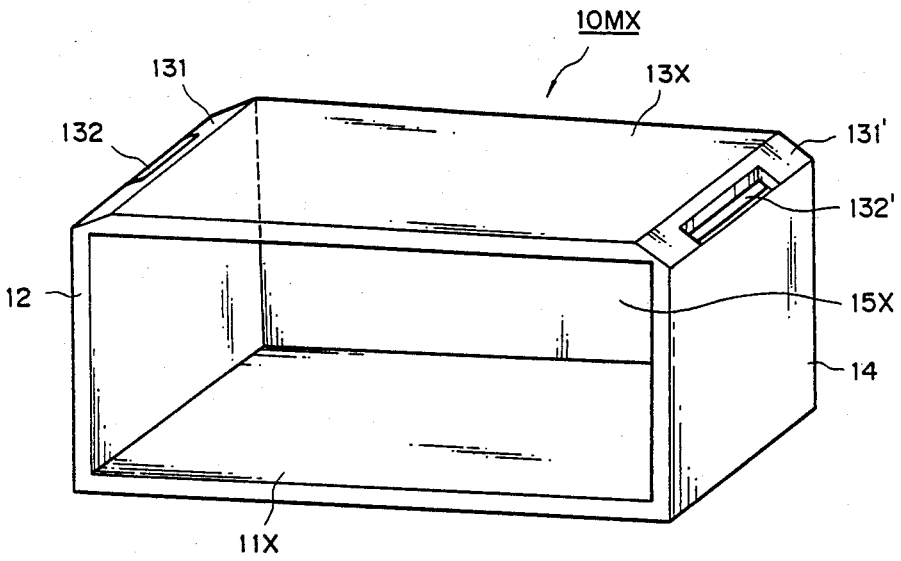
FIGS. 5A and 5B are a perspective and a cross sectional view respectively of a first modular block having double width.
Figure 5B:
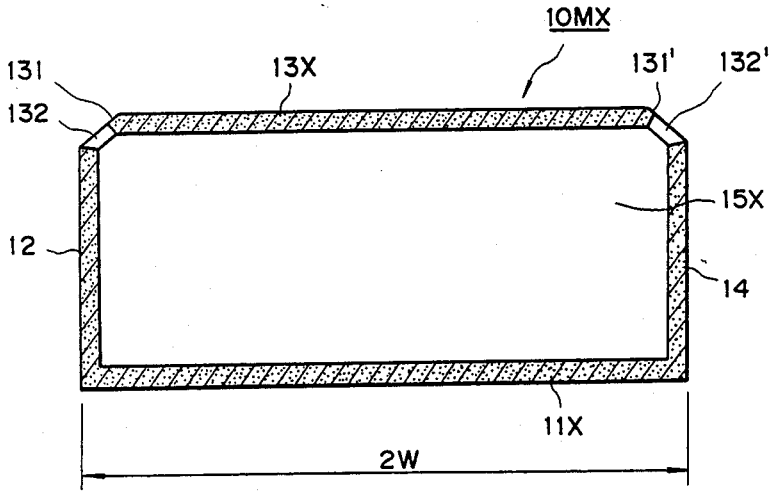
Figure 6A:
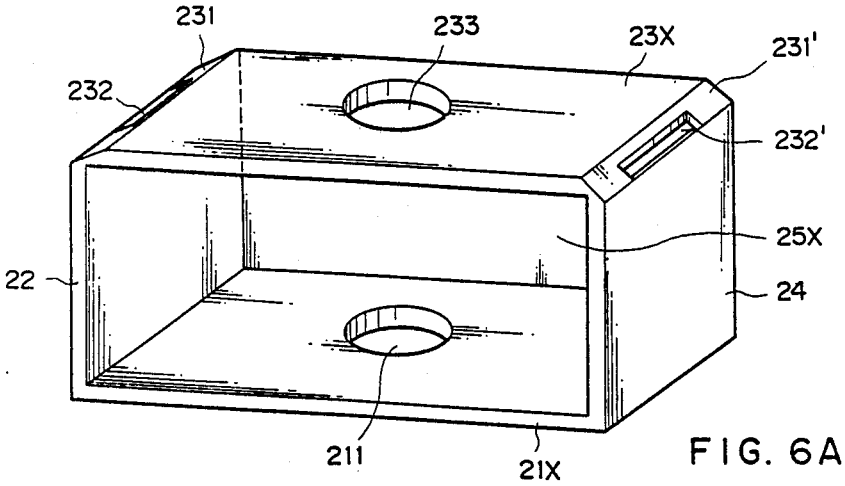
FIGS. 6A and 6B are a perspective and a cross sectional view respectively of a second modular block having double width, modified with the provision of a back wall; and, FIG. 7 is an enlarged sectional plane of a part of the layout in FIG. 1.
Figure 6B:
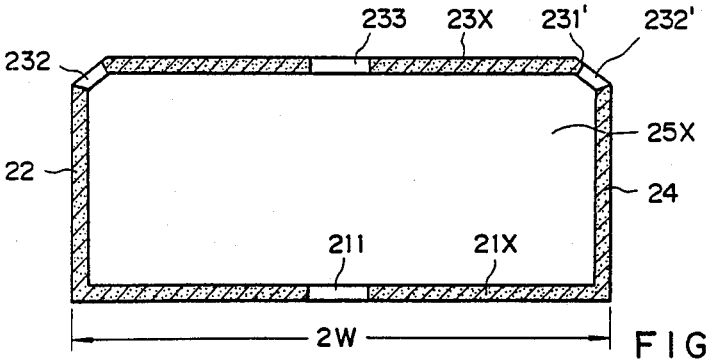

Each of the variations is described hereunder. Referrings to FIGS. 3A and 3B(4A and 4B) for the typical first(second) modular block 10(20), since it is of modified form 10M(20M) is indicated. The block 10M(20M) has a hollow space surrounded mainly by four walls namely, a bottom wall 11 (21), a first side wall 12 (22), a top wall 13 (23) and a second side wall 14(24).

Two top corners of the hollow cross section are chamfered to form tapered surfaces 131, 131'(231,231') with downward slope and are provided with two elongated slots 132, 132' (232,232').

With the provision of a back wall 15(25), the basic type modular block 10 (20) becomes modified type 10M (20M).

The fundamental features of blocks 10 and 20 are all the same except that in the type 20 or 20M a drain opening 211 is provided in the bottom wall 21 and a handling opening 233 is provided in the top wall 23 and generally aligned with the opening 211.

Slots 132,132' (232,232') aim at collecting overhead or rain water from above. The layer handling opening 233 may serve the same purpose.

The dimensions of a typical modular block are indicated with a length L, a height H, a width W, and a wall thickness T. For practical use, each dimension may be as follows:

L: 10–15 cm;
H: 20–30 cm;
W: 20–30 cm; and,
T: 1–2 cm.

In the embodiment shown in FIGS. 5A,5B and 6A,6B corresponding to FIGS. 3A, 3B and 4A, 4B, only the width W of the blocks are doubled.

Figure 2:
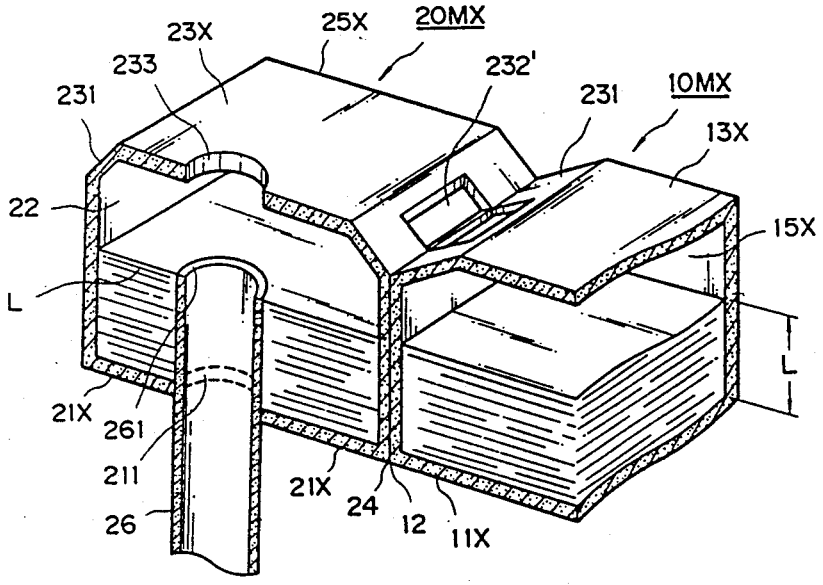
FIG. 2 is a partial cut away perspective to show the joining side by side of a first modular block and a second modular block, both with back wall provided.

FIG. 2 shows a 10MX type block laying side by side with a 20MX type block having their backs 15X and 25X supposedly against the dado surrounding the roof top. Bottom walls 11X and 21X rest upon the roof floor and the sides 12 and 24 are joined together. All the contact junctions are adhered with suitable mortar or adhesive without any gap that would permit the leakage of water therethrough.

In FIG. 2, it can also be seen that an overflow pipe 26 is inserted through the drain opening 211 with means that is water tight but can be easily dismantled for the cleaning of the inner floor. The pipe 26 is raised upon the bottom wall 21X with its upper end 261 at a height L to achieve the resulting liquid level desired. The height L is adjustable by pulling or pushing through handling opening 233. The air space between the level L and the inside surface of the top wall 23 serves for the free ventilation of air so that heat insulation effect can be furthered.

Figure 1:
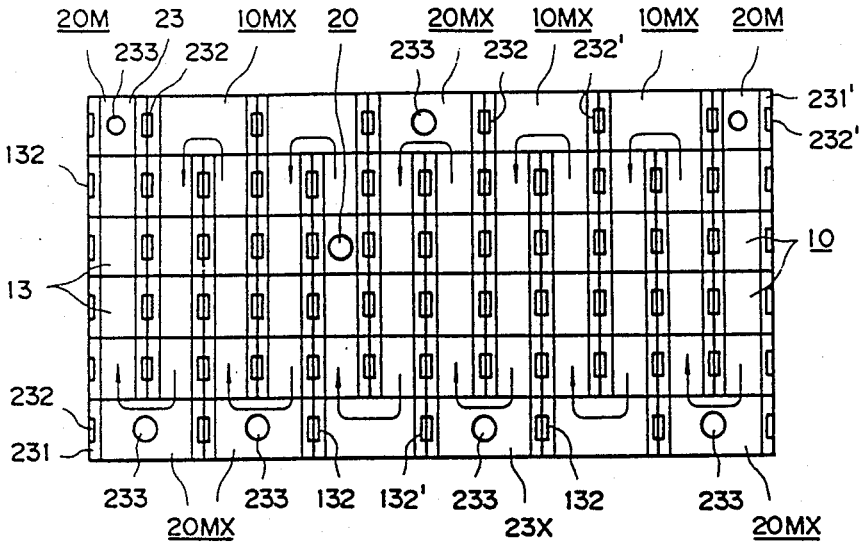
FIG. 1 shows a plan view of a general layout of a typical roof protection layer according to the present invention.
Figure 7:
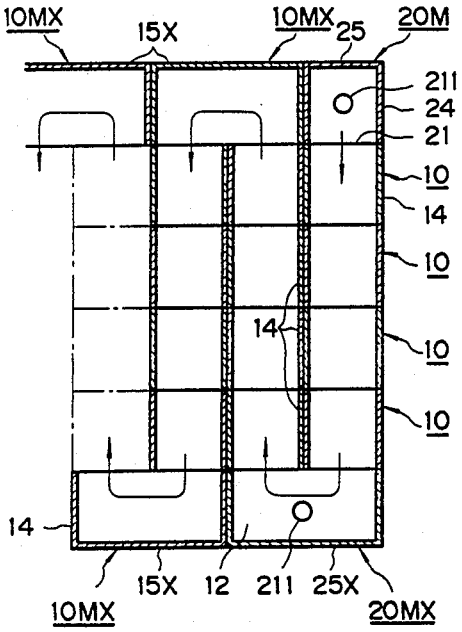

Referring now to FIGS. 1 and 7, the general layout of the blocks in a typical floor pattern and an enlarged horizontal section thereof is shown. The layer having a water flow path as shown by the arrows is constituted mostly of type 10 blocks, which are the simplest hollow see-through ones. The type modified block with the provision of a back wall, and in double width, is type 10MX, also shown. Single width type 20 blocks may be deployed in the middle of the path, yet type 20X is absent in this layout pattern. Type 20M is disposed against the dado at the beginning or finishing end of the route. Types 20MX have to be in positions against the dado, where water flow makes a U turn. The flow of water is arbitrarily shown in a uni-direction as indicated by the arrow; however, variations are possible by changing the elevations of the roofing floor from point to point where the original downpouring drains existed. The level "L" of the overflow pipes may also dominate the direction of flow.

In such layout of the protection layer, the overhead or rain water enters into the layer through slots 132(232) and openings 233, and is reserved therein like a pool at a depth L which is set by the height of the overflow pipe 26 raised above the pool floor. Just like the aforesaid, the height of the overflow pipes L at various points may change the direction of water flow. The air space provided upon the water surface enhances the ventilation and in turn the insulation efficacy.

The present invention further exhibits many advantages, to name some:

(1) Ceramic material is inherently water-repellent and water would not leak therethrough onto the original concrete roofing floor.

(2) Water and air layers inside the block would block away the direct sunshine and weathering effect from without and provide insulation to heat and cold. Therefore, it is suitable for any severe temperature condition, polar or tropical, and would result in a comfortable living environment and eliminate energy expense of air conditioning.

(3) Ceramic blocks are easily fabricated to meet any shape and size requirement, the product surface is smooth and good looking, and can easily be cleaned from dust even if it does adhere to the block surface;

(4) Ceramic is durable, being produced under a temperature as high as 1200 C. Long time exposure to the sunshine would not scorch it, and ceramics may be made into any color desired and would not fade easily under weathering, especially when well glazed.

I claim:

1. A roof protection insulation layer comprising a laid plane according to a predetermined pattern of a plurality of ceramic hollow blocks including:

a first type modular block having four surrounding walls to form a general rectangular hollow cross-section that can be see through, said surrounding walls comprising one top and bottom wall and two side walls, said top wall having its two corners chamfered to form tapered surfaces with an elongated slot provided therein to take rain water from overhead;

a second type modular block having the same structure as the first type except having in the bottom wall a drain opening with an overflow pipe raised thereupon and being adjustable to a desired level;

said two types of modular block being optionally provided with a back wall and also having its width multiplized;

said blocks being joined with hollow spaces communicable to form therein a reserving pool with water at preset level and an air space thereabove, the reserved water with well ventilated air serving an effective insulation layer on the roof to block away direct sunshine and weathering.

2. Roof protection layer according to claim 1, wherein the second type modular block is further provided in its top wall with a handling opening aligned with the drain opening in the bottom wall to facilitate the installation or adjustment of the overflow pipe inserted in the drain opening.

3. Roof protection layer according to claim 1, wherein the bottom walls of said blocks are in contact with the roof flooring, back walls thereof contact against surrounding dadoes of the roof and side walls contact either with adjacent blocks or possible above-said dado, all the contact surface are adhered with leak proof adhesives.

4. Roof protection layer according to claim 2, wherein the insertion of the overflow pipe is done with leak proof means yet is easily dismountable and adjustable as desired.

* * * * *